US008262425B1

(12) United States Patent
Jones

(10) Patent No.: US 8,262,425 B1
(45) Date of Patent: Sep. 11, 2012

(54) SOLAR SURF BOARD

(75) Inventor: Anthony William Jones, Garden Grove, CA (US)

(73) Assignee: Anthony William Jones, Westminster, CA (US)

( * ) Notice: Subject to any disclaimer, the term of this patent is extended or adjusted under 35 U.S.C. 154(b) by 132 days.

(21) Appl. No.: 12/802,222

(22) Filed: Jul. 29, 2010

(51) Int. Cl.
*B63B 35/81* (2006.01)

(52) U.S. Cl. ..... 441/74; 320/114

(58) Field of Classification Search ..... 441/74; 280/809, 816; 320/114; 439/505
See application file for complete search history.

(56) References Cited

U.S. PATENT DOCUMENTS

| | | | | |
|---|---|---|---|---|
| 5,590,908 | A * | 1/1997 | Carr | 280/809 |
| 7,442,077 | B2 * | 10/2008 | Peress et al. | 439/505 |
| 8,080,975 | B2 * | 12/2011 | Bessa et al. | 320/114 |
| 2008/0101159 | A1 * | 5/2008 | Pope | 367/131 |

* cited by examiner

*Primary Examiner* — Lars A Olson

(57) ABSTRACT

The solar surfboard is a full functioning surfboard; it can be made in all sizes of surfboards, short board, long board or standup paddle boards. The solar surfboard works the same way as any surfboard, except it has a solar charging system under the fiberglass bonded to the foam core to keep it safe and waterproof, it collects the suns radiation and converts it into electricity for the purpose of charging small electrical devices, such as cell phones, I pods, mp3 players, and various electrical devices, it replaces the need for costly toxic batteries, and damage to landfills, the solar surfboard is a green sustainable energy source that can be used for charging when no electrical infrastructure is available, the thin film solar panels or solar cells used only weigh ounces, it looks the same as a regular surfboard and works the same as a regular surfboard.

1 Claim, 4 Drawing Sheets

SOLAR SURF BOARD

The Solar Surfboard is a real useable surfboard; it can be made in any size or style surfboard made today, it is manufactured in the same way as all surfboards are manufactured; except it has a solar system imbedded into the foam core and completely covered over with fiberglass and resin, to prevent water from corroding the electrical components, it is completely water proof, the access port plug is the only entry to electronics, port plug has a water tight o ring seal screw which prevents water leakage, with an Allen key or straight screw design both available, my prototype has and Allen key design.

Picking the foam blank you will need, foam blanks are made of polyurethane or expandable polystyrene (EPS) or epoxy, all are used in the surfboard industry for the purpose of making surfboards.

Outlining the blank, there are many shapes and sizes, and you will need to pick the surfboard shape you desire. After picking the shape of the surfboard you will need to pick the template of that shape you have chosen, templates are made of thin plywood light and easy to handle and maneuverable, you now will need to draw your lines on the surfboard blank with a pencil using the chosen template, after making the outline, you will cut off the excess foam from the blank following the pencil lines with a wood hand saw.

For my prototype Solar Surfboard I choose a 9 foot 4 inch long 3 inches thick blank, all solar cells can be used for a solar surfboard they are very thin and light before they go into a solar panel, but I choose a 8 watt thin film for my prototype, my thin film solar panel thickness 0.5, length 60 inches, width 13.5 inches, weighs 17 ounces, battery is 3 inch×2 inch and weighs 4 ounces, the plug including o ring screw and 22 gauge attaching wires weights 2 ounces, I have unscrewed the o ring plug many times after using and it does not leak. Total weight 1 LB 7 ounces, the added weight is not an issue, and does not hinder the performance of the surfboard, I have been personally using this solar surfboard since June of 2009, it is my favorite surfboard, I have used it in very large surf and very small surf, I cannot tell it has any solar system imbedded in its construction, it paddles well with no drag, it catches waves well, I cannot see any difference between a regular surfboard and this solar surfboard, I am very pleased with the outcome of this invention.

After cutting the shape out from the template of your surfboard, you will need to skin down to your desired thickness that you have decided on, some want thick some want thin, you will use a plainer to skin down the surfboard, mine I made 3 inches thick, after you have planed and shaped your board to the thickness you have decided on, you will fine tune the blank with sandpaper first a heavy 80 grit and finality down to 200 grit for a smooth finish, when finish is completely smooth on entire surfboard, top bottom, and sides you now can paint a design on it if you choose to or just leave the blank white like the foam is naturally colored.

Solar System final electrical check before installation, after check is completed and solar system is working properly we will need to outline the desired area for the cavity that the solar panel, battery and access plug we be imbedded, you can sand it out or router to desired depth, checking depth periodically to make sure the cavity is not to deep or not to shallow, to deep it will leave an indent when finished, to shallow it will leave a bump and not be smooth with rest of surfboard. It is very important for the solar system to be even with the rest of the surfboard. When depth is achieved you will lay in solar system before the fiberglassing of the surfboard.

Certain items need to be taped off Before the glassing begins so they won't be bonded to the rest of the surfboard, access plug, fin boxes, the tape later will be pulled off the access plug and fin boxes. the tape prevents the resin and fiberglass from bonding them to the surface of the surfboard and will leave them accessible for their purpose. Now that the solar system is in place and the fit is correct, and all taping has been done it is time to prepare for the fiberglassing of the surfboard, all manufactures start with the bottom of the surfboard first and this is where we will start, some use one layer of 4 ounce fiberglass cloth, I'm going to use one layer of 6 ounce fiberglass cloth on the bottom for strength, I chose to put the solar system on the bottom for two reasons, you always set your surfboard upside down while not in the water so the bottom does not get damaged from pebbles or rocks and it can charge at that time, The top has wax on it and will reduce your charging capabilities also the top usually has two layers of fiberglass which will cut dramatically the suns radiation going to the panel, if a customer wants the panel on the top it can be done in this way.

Cutting out the fiberglass cloth to the surfboard shape, and the Laying down of the fiberglass cloth is a learned art, you must smooth out the wrinkles not by hand but by using a paint brush this is the best way and easiest way, it does not catch on the fiberglass while moving the cloth, after the lay down is completed you will be ready for the next step of measuring the correct amount of resin and hardener for your size surfboard we will calculate the amount of resin for the size of surfboard that we are making, we can use a polyester resin or epoxy resin both will work well, but epoxy is stronger and the cost is higher, I chose epoxy for my solar surfboard.

On my solar surfboard bottom I used 10 ounces resin and 5 hardener total of 15 ounces we use a weight scale to be exact it is a 2 to 1 ratio, all resins must be mixed thoroughly this is very important if not mixed correct the mixture may not dry in some spots and the surfboard is ruined, after mixing thoroughly you will now pour the measured amount of resin for this surfboard size down the middle of the surfboard and you will use a squeeze like a body shop repair guy would use for applying bondo into dents on car bodies, you will move the resin up and down the surfboard to saturate the fiberglass and take out the bubbles, after you have removed the bubbles and the fiberglass is saturated properly you will now clean the excess resin from the rails with a paint brush this will smooth out the resin deposits before forming and hardening, this will eliminate hours of sanding the hardened resin drips from the sides and rails. You will wait till the next day before fiberglassing the other side.

The top of surfboards get much more use, from standing, moving your feet, and paddling on them, over time this will crush the foam core, so we will double fiberglass the top to make it stronger for strength, I used two layers of 4 ounce fiberglass cloth for my solar surfboard, by using two layers of fiberglass cloth it will reinforce and strengthen the deck but not make it too heavy, fiberglassing the top is the same process as the bottom you will need to duplicate the procedure by smoothing out each layer of the fiberglass with a paint brush to make sure it is even all over, after this is completed now you will prepare your resin mixture, but because of the extra two layers of cloth that you have laid down together, you will need to increase the amount of resin to saturate the cloth, for my solar surfboard top I used 14 ounces of resin and 7 ounces of hardener total weight 21 ounces, the added amount saturated both layers of cloth properly, after this stage you will let harden over night to cure and harden properly.

Grinding the surface, bottom and edges of your cured solar surfboard is your next step, you will need to even out the fiberglass and resin high spots to have a smooth surface before your last and final thin coat of resin called the hot coat, this will fill in small pits and low spots of the surface, bottom and sides of the solar surfboard, your fin holders have been ground even with surface and are now ready to be taped off again to keep any final resin from entering the screw holes, now the hot coat is ready for the solar surfboard, bottom first, I used 7 ounces resin and 3.5 ounces hardener total weight 10.5 ounces, you will let dry over night. Top repeat the hot coat process, same amount of resin and hardener, let cure over night and harden.

After drying over night your next and final two steps are to sand and polish, you will sand completely for the last time with 80 grit sandpaper, and work down to 220 grit for a smooth finish, after sanding you will now use a razor blade to peel the tape from the fin boxes and electrical access plug removing all small particles of tape before polishing the surfboard, this now gives you access to the fin boxes to install the fins and your electrical port plug for your charging wire, you now will apply polishing compound to your electrical buffer machine buffing pad continuously until it has a clean and polished look to the surfboard surface, when this is finished you have now successfully completed the correct procedures of making a solar surfboard.

BRIEF DESCRIPTION OF THE SEVERAL VIEWS OF THE DRAWINGS

In order that the invention may be more fully comprehended it will now be described, by way of example, with reference to the accompanying drawings in which.

DETAILED DESCRIPTION OF THE INVENTION

Figure 1:
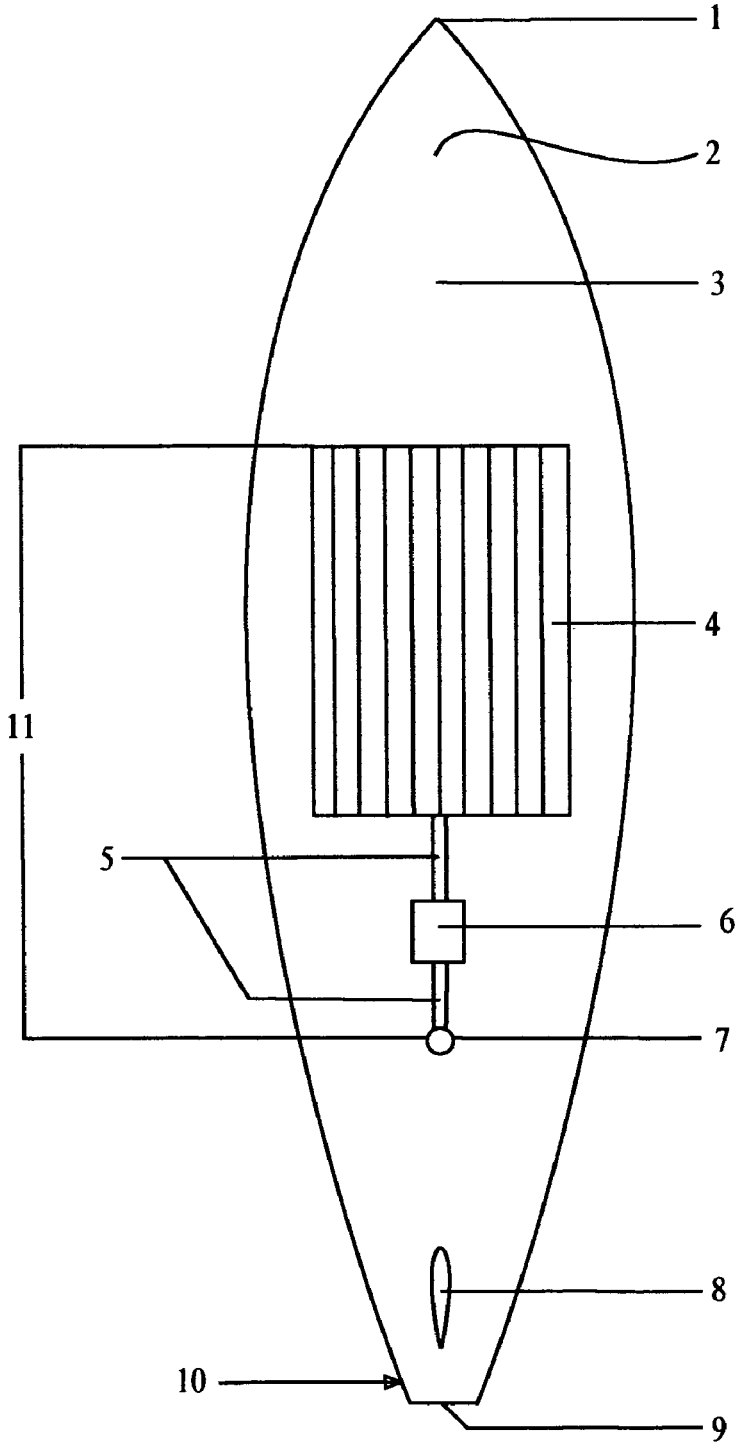
FIG. 1 is bottom view plan of a surfboard embodying the features of the invention.

Referring to the drawings there is shown generally a surfboard 10. The board is an elongated buoyant member having a fore extremity 1. and an aft extremity 9. with a fin 8. In the aft tail area for steering the surfboard 10. The board may be made of polyester foam 3. or epoxy foam 3. or any conventional materials used in surfboard 10. Construction including a complete covering of the board with a fiberglass shell 2. that protects the inner foam core 3.

The surfboard 10. is provided with a solar panel 4. usually on the bottom of the surfboard 10. my prototype has the solar panel 4. on the bottom.

A battery 6. is added to the surfboard 10. to collect the electrical charge coming from the solar panel 4. to store the electrical energy until needed, wires 5. are used to transfer the electrical energy from the panel to the battery 6. and direct it to the access electrical port plug with o-ring seal screw 7. To complete the circuit and make available and accessible to charge electrical devices, like cell phones, I pods, digital cameras, etc. The access electrical port plug has an o-ring seal 7. on the screw to seal out water and keep electrical components protected from any outside element damage, this o-ring seal 7. makes it water tight and completely waterproof, it can be an alien key style screw or screw driver style, prototype is an Allen key style.

The solar surfboard works exactly the same as any surfboard 10. except it has a solar system 11. imbedded into its foam core 3. This gives this surfboard 10. the ability to charge electrical devices, thus naming it The Solar Surfboard.

FIG. 1. shows 1,2,3,4,5,6,7,8,9,10,11, entire surfboard with all solar components in their place including the surfboard fin 8.

Figure 2:
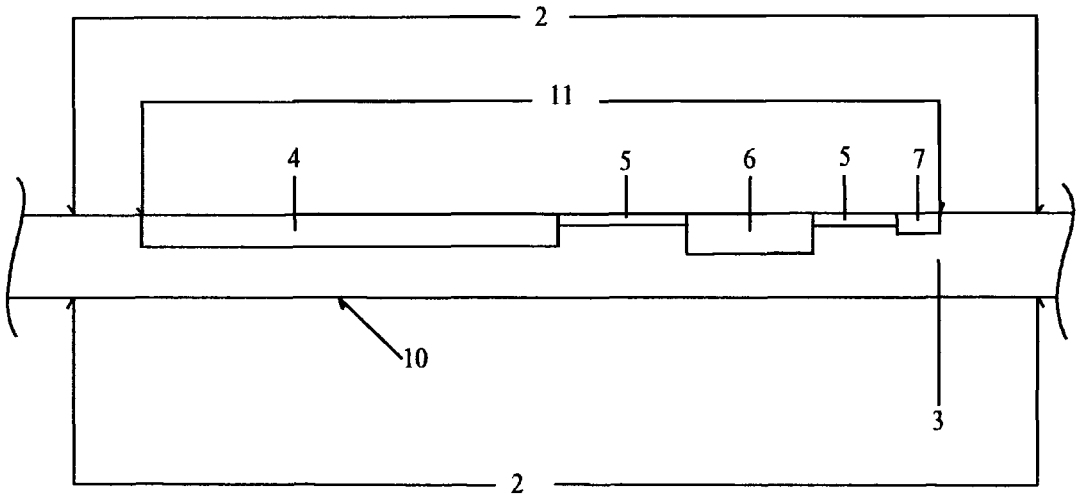
FIG. 2 is side view plan of cavities where the solar system will reside.

FIG. 2. shows 1,2,3,4,5,6,7,9,10,11, side view of surfboard with all solar components in their place except the surfboard fin 8.

Figure 3:
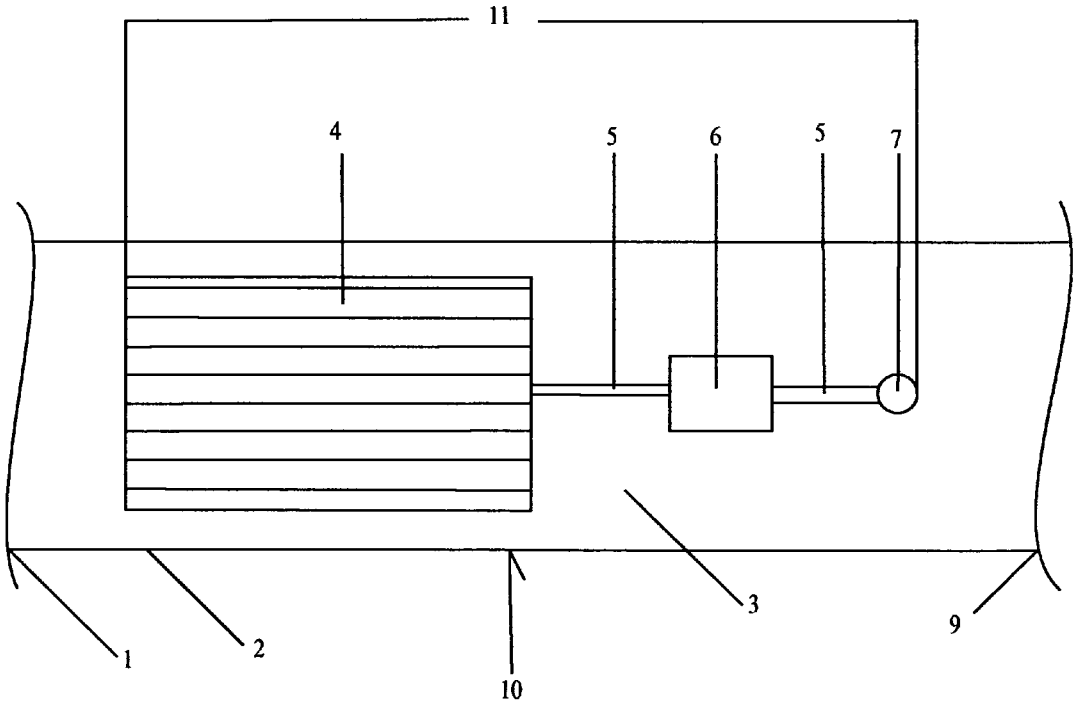
FIG. 3 is top view plan showing solar system in place.

FIG. 3. shows 1,2,3,4,5,6,7,9,10,11, an elevated view of the bottom of surfboard with all solar components in their place except the surfboard fin 8.

Figure 4:
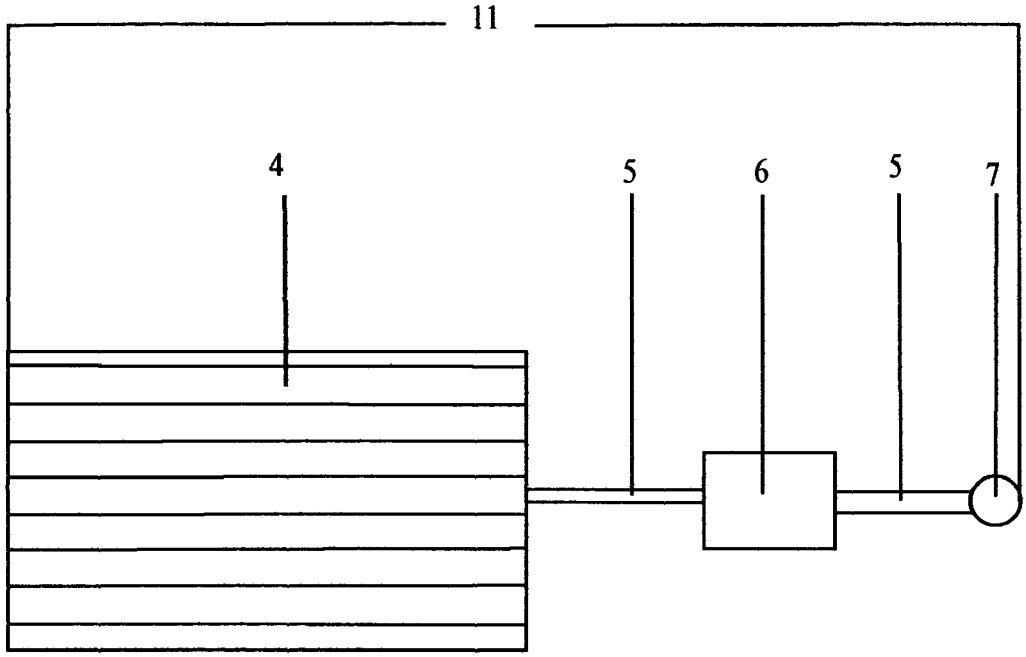
FIG. 4. is solar system with wires battery and o-ring plug alone.

FIG. 4. shows 4,5,6,7,11 elevated view of solar system components alone with no surfboard.

The invention claimed is:

1. A watertight solar surfboard (10) including an internal battery (6) for capturing solar radiation and converting it into electrical power for use in charging battery operated external electrical devices, said surfboard being comprised of a fiberglass shell (2), with a fore extremity (1), an aft extremity (9), an inner foam core (3), a fin (8) disposed near said aft extremity, a solar panel (4) that is disposed on a bottom surface of said shell, wires (5) that connect said solar panel to said battery to transfer electrical energy from said solar panel to said battery and an O-ring seal screw (7) to seal out water from an access electrical port plug for connecting external electrical devices to said battery.

* * * * *